United States Patent [19]

Otobe et al.

[11] Patent Number: 4,729,361

[45] Date of Patent: Mar. 8, 1988

[54] FUEL SUPPLY CONTROL METHOD FOR INTERNAL COMBUSTION ENGINES, WITH ADAPTABILITY TO VARIOUS ENGINES AND CONTROLS THEREFOR HAVING DIFFERENT OPERATING CHARACTERISTICS

[75] Inventors: Yutaka Otobe, Shiki; Masataka Chikamatsu, Utsunomiya, both of Japan

[73] Assignee: Honda Giken Kogyo K.K., Tokyo, Japan

[21] Appl. No.: 863,772

[22] Filed: May 15, 1986

[30] Foreign Application Priority Data

May 24, 1985 [JP] Japan ..... 60-112786

[51] Int. Cl.[4] ..... F02D 41/26

[52] U.S. Cl. ..... 123/486; 123/488; 364/431.05

[58] Field of Search ..... 123/478, 480, 486, 488; 364/431.05, 431.12

[56] References Cited

U.S. PATENT DOCUMENTS

| | | | |
|---|---|---|---|
| 4,201,161 | 5/1980 | Sasayama et al. | 123/480 |
| 4,471,742 | 9/1984 | Kishi | 123/480 |
| 4,508,075 | 4/1985 | Takao et al. | 123/480 |

FOREIGN PATENT DOCUMENTS

| | | | |
|---|---|---|---|
| 57-113926 | 7/1982 | Japan | 123/478 |
| 2143055 | 1/1985 | United Kingdom | 123/478 |

*Primary Examiner*—Andrew M. Dolinar

*Attorney, Agent, or Firm*—Arthur L. Lessler

[57] ABSTRACT

A method of controlling fuel supply to an internal combustion engine, wherein a quantity of fuel for supply to the engine is determined by correcting a basic value of the quantity of fuel determined as a function of at least one operating parameter of the engine by correction values dependent upon operating conditions of the engine, and the determined quantity of fuel is supplied to the engine. A value of at least one predetermined operating parameter of the engine is detected. A single voltage creating means is adjusted to set an output voltage therefrom to a desired value. Predetermined one of the correction values has a value thereof set as a function of the output voltage from the voltage creating means and dependent upon the value of the at least one predetermined operating parameter of the engine. Determined is a value of the predetermined one correction value corresponding to the detected value of the at least one predetermined operating parameter of the engine and to the set desired value of output voltage of the single voltage creating means. Preferably, the at least one predetermined operating parameter of the engine includes the rotational speed of the engine, and intake pipe absolute pressure thereof.

7 Claims, 7 Drawing Figures

FUEL INJECTION VALVES
6
INTERNAL COMBUSTION ENGINE
1
THREE-WAY CATALYST
14
13
O2 SENSOR
15
CYL SENSOR
12
Ne SENSOR
11
TW SENSOR
10
TA SENSOR
9
PBA SENSOR
8
7
2
THROTTLE BODY
3(3')
θTH SENSOR
4
PA SENSOR
16
STARTER SWITCH
17
BATTERY
18
ECU
5

| KPRO2 / KPRO1 | | FOR HIGHER ENGINE RPM REGION | | | | |
|---|---|---|---|---|---|---|
| | | KPRO21 (0.96) | KPRO22 (0.98) | KPRO23 (1.00) | KPRO24 (1.02) | KPRO25 (1.04) |
| FOR LOWER ENGINE RPM REGION | KPRO11 (0.96) | VPRO 1-1 | VPRO 1-2 | VPRO 1-3 | VPRO 1-4 | VPRO 1-5 |
| | KPRO12 (0.98) | VPRO 2-1 | VPRO 2-2 | VPRO 2-3 | VPRO 2-4 | VPRO 2-5 |
| | KPRO13 (1.00) | VPRO 3-1 | VPRO 3-2 | VPRO 3-3 | VPRO 3-4 | VPRO 3-5 |
| | KPRO14 (1.02) | VPRO 4-1 | VPRO 4-2 | VPRO 4-3 | VPRO 4-4 | VPRO 4-5 |
| | KPRO15 (1.04) | VPRO 5-1 | VPRO 5-2 | VPRO 5-3 | VPRO 5-4 | VPRO 5-5 |

FIG. 5

| VPROX | 0 ← | | | | | | | | | | | | 2.5 | | | | | | | | | | | | → 5 |
|---|---|---|---|---|---|---|---|---|---|---|---|---|---|---|---|---|---|---|---|---|---|---|---|---|---|
| VPRO | 5-5 | 5-4 | 5-3 | 5-2 | 5-1 | 4-1 | 4-2 | 4-3 | 4-4 | 4-5 | 3-5 | 3-4 | 3-3 | 3-2 | 3-1 | 2-1 | 2-2 | 2-3 | 2-4 | 2-5 | 1-5 | 1-4 | 1-3 | 1-2 | 1-1 |
| KPRO1 | 1.04 | 1.04 | 1.04 | 1.04 | 1.04 | 1.02 | 1.02 | 1.02 | 1.02 | 1.02 | 1.00 | 1.00 | 1.00 | 1.00 | 1.00 | 0.98 | 0.98 | 0.98 | 0.98 | 0.98 | 0.96 | 0.96 | 0.96 | 0.96 | 0.96 |
| KPRO1 | KPRO15 | | | | | KPRO14 | | | | | KPRO13 | | | | | KPRO12 | | | | | KPRO11 | | | | |
| KPRO2 | 1.04 | 1.02 | 1.00 | 0.98 | 0.96 | 0.96 | 0.98 | 1.00 | 1.02 | 1.04 | 1.04 | 1.02 | 1.00 | 0.98 | 0.96 | 0.96 | 0.98 | 1.00 | 1.02 | 1.04 | 1.04 | 1.02 | 1.00 | 0.98 | 0.96 |
| KPRO2 | 25 | 24 | 23 | 22 | 21 | 21 | 22 | 23 | 24 | 25 | 25 | 24 | 23 | 22 | 21 | 21 | 22 | 23 | 24 | 25 | 25 | 24 | 23 | 22 | 21 |

FUEL SUPPLY CONTROL METHOD FOR INTERNAL COMBUSTION ENGINES, WITH ADAPTABILITY TO VARIOUS ENGINES AND CONTROLS THEREFOR HAVING DIFFERENT OPERATING CHARACTERISTICS

BACKGROUND OF THE INVENTION

This invention relates to a fuel supply control method for internal combustion engines, and more particularly to a method of this kind which can adapt a fuel supply control system employing the method to a variety of engines and controls therefor having different operating characteristics.

A fuel supply control system adapted for use with an internal combustion engine, particularly a gasoline engine is widely known, which is adapted to determine the fuel injection period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

According to this proposed fuel control system, while the engine is operating in a normal operating condition, the air/fuel ratio is controlled in feedback mode such that the valve opening period of the fuel injection device is controlled by varying the value of a coefficient in response to the output from an exhaust gas ingredient concentration detecting means which is arranged in the exhaust system of the engine, so as to attain a theoretical air/fuel ratio or a value close thereto (closed loop control), whereas while the engine is operating in one of particular operating conditions (e.g. an idling region, a mixture-leaning region, a wide-open-throttle region, and a fuel-cut effecting region), the air/fuel ratio is controlled in open loop mode by the use of a mean value of values of the above coefficient applied during the preceding feedback control, together with an exclusive coefficient corresponding to the kind of operating region in which the engine is then operating, thereby preventing any deviation of the air fuel ratio from a desired air/fuel ratio, and also achieving required air/fuel ratios best suited for the respective particular operating conditions, to thus reduce the fuel consumption as well as improve the driveability of the engine.

During the above open loop control, it is desirable that the air/fuel ratio should be accurately controlled to the predetermined air/fuel ratios best suited for the respective particular operating regions, by properly applying the respective exclusive coefficients and the mean value of the first-mentioned coefficient. However, there can occur variations in operating characteristics or performance between engines in different production lots, which can result in deviation of the actual air/fuel ratio from the predetermined ones. To eliminate such deviation, it is necessary to change or rewrite contents in a memory (e.g. a read-only memory) which is provided within an electronic control system applied, and stores various correction coefficients, correction variables, etc. required for the fuel supply control.

However, if the memory is a type which cannot be changed or rewritten in stored content, such as a mask ROM, the ROM per se has to be replaced with another one, and it is also necessary to add a change to the mask pattern used for manufacture of the mask ROM, which takes two or three months to have delivery of the new ROM and also requires a large cost.

Further, the deviation of the air fuel ratio from a desired air/fuel ratio can also be due to variations in the performance of various engine operating condition sensors and a system for controlling or driving the fuel injection device, etc. and/or due to aging changes in the performance of the sensors and the system. To adjust the sensors and the system for elimination of such deviation also takes a great deal of time and cost.

Besides, the air fuel ratio varies in different manners depending upon operating conditions of the engine, e.g. between a high engine rpm region and a low engine rpm region.

SUMMARY OF THE INVENTION

It is the object of the invention to provide a fuel supply control method for internal combustion engines, which permits adjusting in a simple manner the air/fuel ratio, which varies in different manners depending upon operating conditions of the engine, for elimination of deviation thereof from desired values so as to adapt itself to a wide variety of engines and controls therefor having different operating characteristics and performance, at the time of delivery of the engines from the plant or at the time of maintenance operation, thereby enabling to largely curtail the cost and time for adjustment of the air/fuel ratio.

The present invention provides a method of controlling fuel supply to an internal combustion engine, wherein a quantity of fuel for supply to the engine is determined by correcting a basic value of the quantity of fuel determined as a function of at least one operating parameter of the engine by correction values dependent upon operating conditions of the engine, and the determined quantity of fuel is supplied to the engine.

The method according to the invention is characterized by the following steps:

(1) detecting a value of at least one operating parameter of the engine;

(2) adjusting a single voltage creating means to set an output voltage therefrom to a desired value, predetermined one of the correction values having a value thereof set as a function of the output voltage from the voltage creating means and dependent upon the value of the at least one predetermined operating parameter of the engine; and (3) determining a value of the predetermined one correction value corresponding to the detected value of the predetermined at least one operating parameter of the engine and to the set desired value of output voltage of the single voltage creating means.

Preferably, the at least one predetermined operating parameter of the engine includes the rotational speed of the engine, and intake pipe absolute pressure thereof.

Further, preferably, the basic value of the quantity of fuel is multiplied by the determined value of the predetermined one correction value together with the other correction coefficients, to determine the quantity of fuel for supply to the engine.

Further, preferably, the determined value of the predetermined one correction value is added to the basic value of the quantity of fuel together with the other correction variables, to determine the quantity of fuel for supply to the engine.

Furthermore, preferably, a plurality of predetermined values of the predetermined one correction value are stored in a table in a manner corresponding, respectively, to as many predetermined values of the output voltage from the single voltage creating means.

The above and other objects, features, and advantages of the invention will be more apparent from the ensuing detailed description taken in conjunction with the accompanying drawings.

BRIEF DESCRIPTION OF THE DRAWINGS

FIG. 5 is a view showing an example of the table of FIG. 3 with exemplary values of VPRO, KPRO1, and KPRO2;

DETAILED DESCRIPTION

Figure 1:
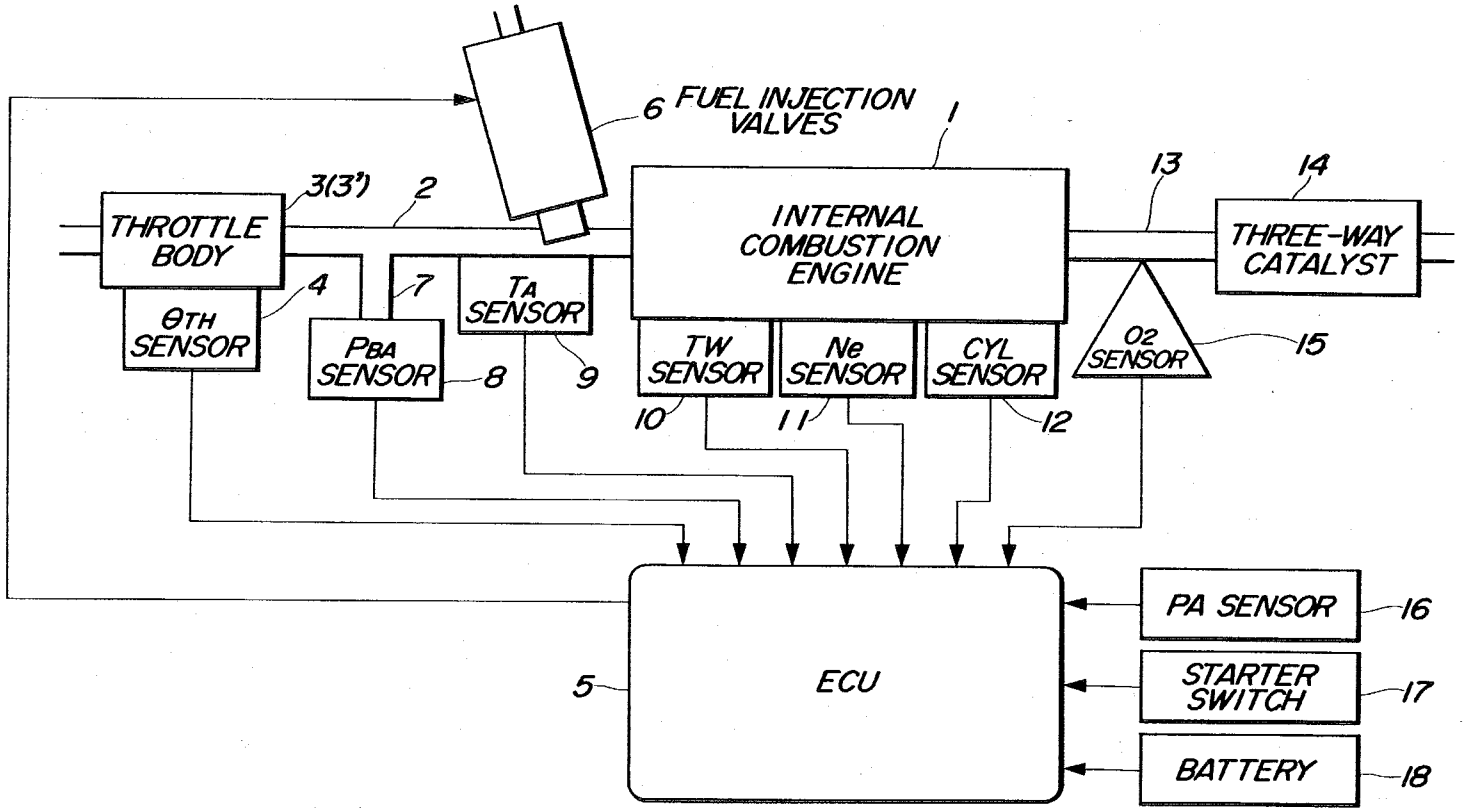
FIG. 1 is a block diagram of the whole arrangement of a fuel supply control system for internal combustion engines, to which is applied the method according to the present invention.

The present invention will now be described in detail with reference to the drawings. Referring first to FIG. 1, there is illustrated the whole arrangement of a fuel supply control system for internal combustion engines, to which is applied the method according to the invention. Reference numeral 1 designates an internal combustion engine which may be a four-cylinder type, for instance. An intake pipe 2 is connected to the engine 1, in which is arranged a throttle body 3 accommodating a throttle valve 3', which in turn is coupled to a throttle valve opening ($\theta$th) sensor 4 for detecting its valve opening and converting same into an electrical signal which is supplied to an electronic control unit (hereinafter called "the ECU") 5.

Fuel injection valves 6 forming a fuel injection device are arranged in the intake pipe 2 at locations between the engine 1 and the throttle valve 3', which correspond in number to the member of the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure sensor (PBA) sensor 8 communicates through a conduit 7 with the interior of the intake pipe 2 at a location downstream of the throttle valve 3'. The absolute pressure sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure sensor 8 and also electrically connected to the ECU 5 for supplying same with an electrical signal indicative of detected intake air temperature.

An engine temperature (TW) sensor 10, which may be formed of a thermistor or the like, is mounted in the cylinder block of the engine 1 in a manner embedded in the peripheral wall of the cylinder block having its interior filled with cooling water, an electrical output signal of which is supplied to the ECU 5.

An engine rotational angle position (Ne) sensor 11 and a cylinder-discriminating (CYL) sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the cylinder block of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure (PA) and a starter switch 17 for actuating the engine starter, not shown, of the engine 1, respectivelv, for supplying an electrical signal indicative of detected atmospheric pressure and an electrical signal indicative of its own on and off positions to the ECU 5.

Further electrically connected to the ECU 5 is a battery 18, which supplies the ECU 5 with a supply voltage for operating the ECU 5.

Figure 2:
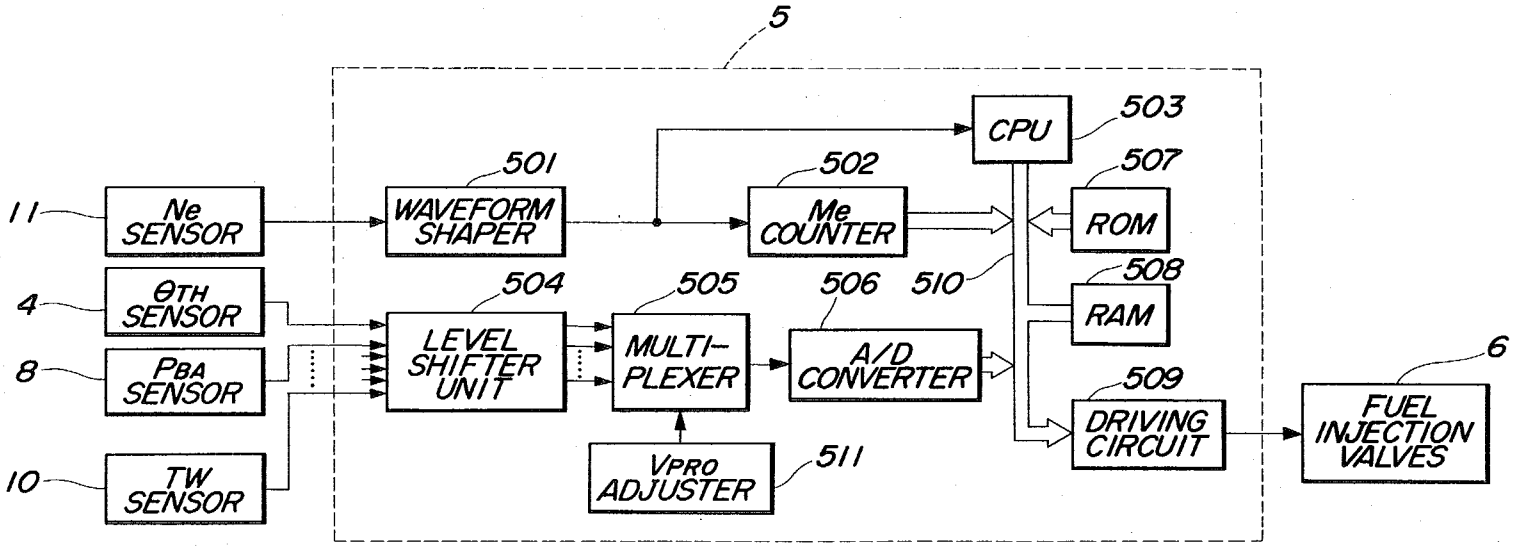
FIG. 2 is a circuit diagram of the interior construction of an electronic control unit appearing in FIG. 1.

FIG. 2 shows a circuit configuration within the ECU 5 in FIG. 1. An output signal from the engine rotational angle position (Ne) sensor 11 in FIG. 1 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the engine rotational angle position (Ne) sensor 11, and therefore its counted value Me corresponds to the reciprocal of the actual engine rpm Ne. The Me value counter 502 supplies the counted value Me to the CPU 503 via a data bus 510.

The respective output signals from the throttle valve opening ($\theta$th) sensor 4, the intake pipe absolute pressure (PBA) sensor 8, the engine coolant temperature (TW) sensor 10, etc. have their voltage levels successively shifted to a predetermined voltage level by a level shifter unit 504 and applied to an analog-to-digital converter 506 through a multiplexer 505. Connected to the multiplexer 505 is a VPRO value adjuster 511 which supplies the analog-to-digital converter 506 through the multiplexer 505 with an adjusted voltage VPRO determining the value of the correction coefficient KPRO which are applied during engine operation in certain particular operating regions, as hereinafter described. This VPRO value adjuster 511 may comprise, for example, a variable voltage supply circuit formed of voltage dividing resistances or the like and preferably connected to a constant voltage-regulator circuit, not shown. The analog-to-digital converter 506 successively converts into digital signals analog output voltages from the aforementioned various sensors and the VPRO value adjuster 511, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores a control program executed within the CPU 503, a map of a basic fuel injection period Ti for the fuel injection valves 6, of which stored values are read in dependence on intake pipe absolute pressure and engine rpm, correction coefficient maps, etc. The CPU 503 executes the control program stored in the ROM 507 to calculate the fuel injection period TOUT for the fuel injection valves 6 in response to the various engine operating parameter signals and the parameter signals for correction of the fuel injection period, and supplies the calculated value of fuel injection period to the driving circuit 509 through the data bus 510. The driving circuit 509 supplies driving signals corresponding to the above calculated TOUT value to the fuel injection valves 6 to drive same.

The fuel injection period of the fuel injection valves 6, that is, TOUT value is given by the following equation:

$$TOUT = Ti \times KPRO \times K_1 + K_2 \quad (1)$$

where Ti represents a basic value of the fuel injection period of the fuel injection valves 6, which is read from the ROM 507 in accordance with engine rpm Ne and intake pipe absolute pressure PBA.

In the equation (1), KPRO is a correction coefficient for adjusting the air/fuel ratio of the mixture to such values as to enable the engine to achieve optimum operating characteristics. This correction coefficient KPRO is applicable in particular operating regions other than the $O_2$ sensor output-responsive feedback control region and including an $O_2$ sensor-deactivated region, an idling region, a wide-open-throttle region, a predetermined low speed open-loop control region, and a predetermined high speed open-loop control region, singly or together with other correction coefficients exclusively provided for the respective particular operating regions. In these particular operating regions, usually the value of the correction coefficient KPRO is set to 1.0 or a value close thereto so as to achieve air/fuel ratios best suited for the operating regions.

According to the invention, the correction coefficient KPRO in the multiplicative term of the equation (1) is set to a value corresponding to the output voltage of the single voltage-creating means, i.e. the VPRO value adjuster 511, so as to achieve air/fuel ratios optimal to operating conditions of the engine. $K_1$ and $K_2$ are respectively correction coefficients and correction variables calculated in response to various engine operating parameter signals, and are adjusted to such values as to enable the engine to achieve optimum characteristics in respect of fuel consumption and exhaust emission and so on in response to operating conditions of the engine.

Figures 3, 6:
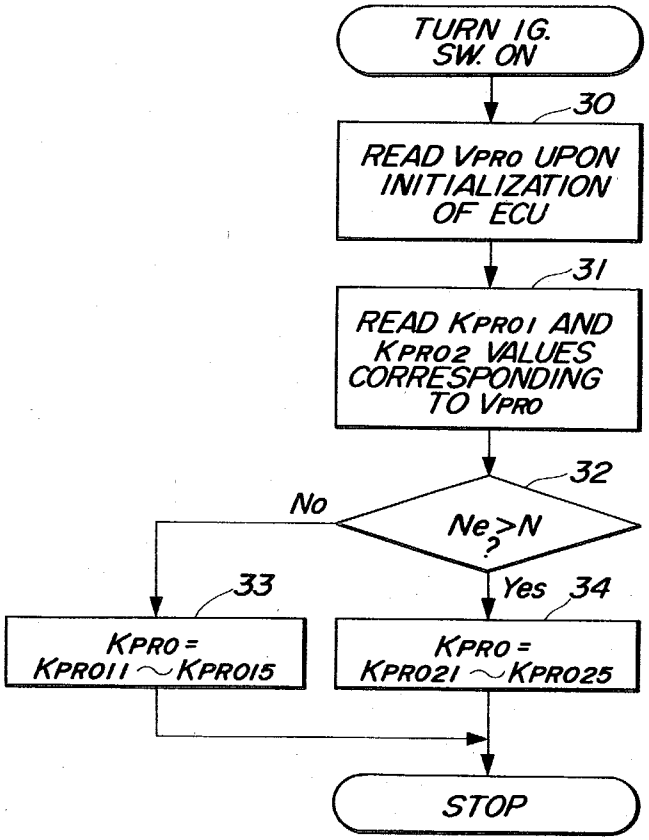
FIG. 3 is a view showing a table of correction coefficients KPRO1 and KPRO2, and set voltage value VPRO, according to the method of the invention.
FIG. 6 is a flowchart of a manner of executing the method of the invention.

FIG. 3 shows a table of the correction coefficient KPRO, and set output voltage VPROX from the VPRO value adjuster 511, for determining the coefficient value from the voltage value, according to the method of the invention. As shown in (a) of FIG. 4, the set voltage value VPROX is divided into 25 steps ranging from 0 volt to 5 volts, which can be provided by respective different combinations of the voltage dividing resistances of the VPRO value adjuster 511, and to each of which corresponds an address code of the value VPRO.

The correction coefficient KPRO comprises two coefficients KPRO1 and KPRO2 which are applied, respectively, in a lower engine rpm region and in a higher engine rpm region, wherein either KPRO1 or KPRO2 is selected according to the value of the engine rpm, to thereby enable the engine to achieve optimum air fuel ratios throughout a wide range of engine rpm (Ne). In the table of FIG. 3, as the correction coefficients KPRO1 and KPRO2 there are respectively provided five predetermined values KPRO11–KPRO15 and KPRO21–KPRO25. The values KPRO11–KPRO15 and KPRO21–KPRO25 of the correction coefficients KPRO1 and KPRO2 both range from 0.96 to 1.04 with a difference of 0.02 between adjacent values thereof. The correction coefficient KPRO1 varies from one of the predetermined values to its adjacent value each time the VPRO value varies by five steps, while the correction coefficient KPRO2 varies from one of the predetermined values to its adjacent value each time the VPRO varies by one step.

Namely, the correction coefficient KPRO2 varies from 0.96 to 1.04 or from 1.04 to 0.96 by five steps each time the correction coefficient KPRO1 varies by one step. This setting of the relationship between the correction coefficients KPRO1 and KPRO2 is intended to set the value VPRO on the basis of the correction coefficient KPRO1. However, the setting may be reverse to that just mentioned above with respect to the VPRO value, such that the VPRO value is set on the basis of the correction coefficient KPRO2.

Figure 4:
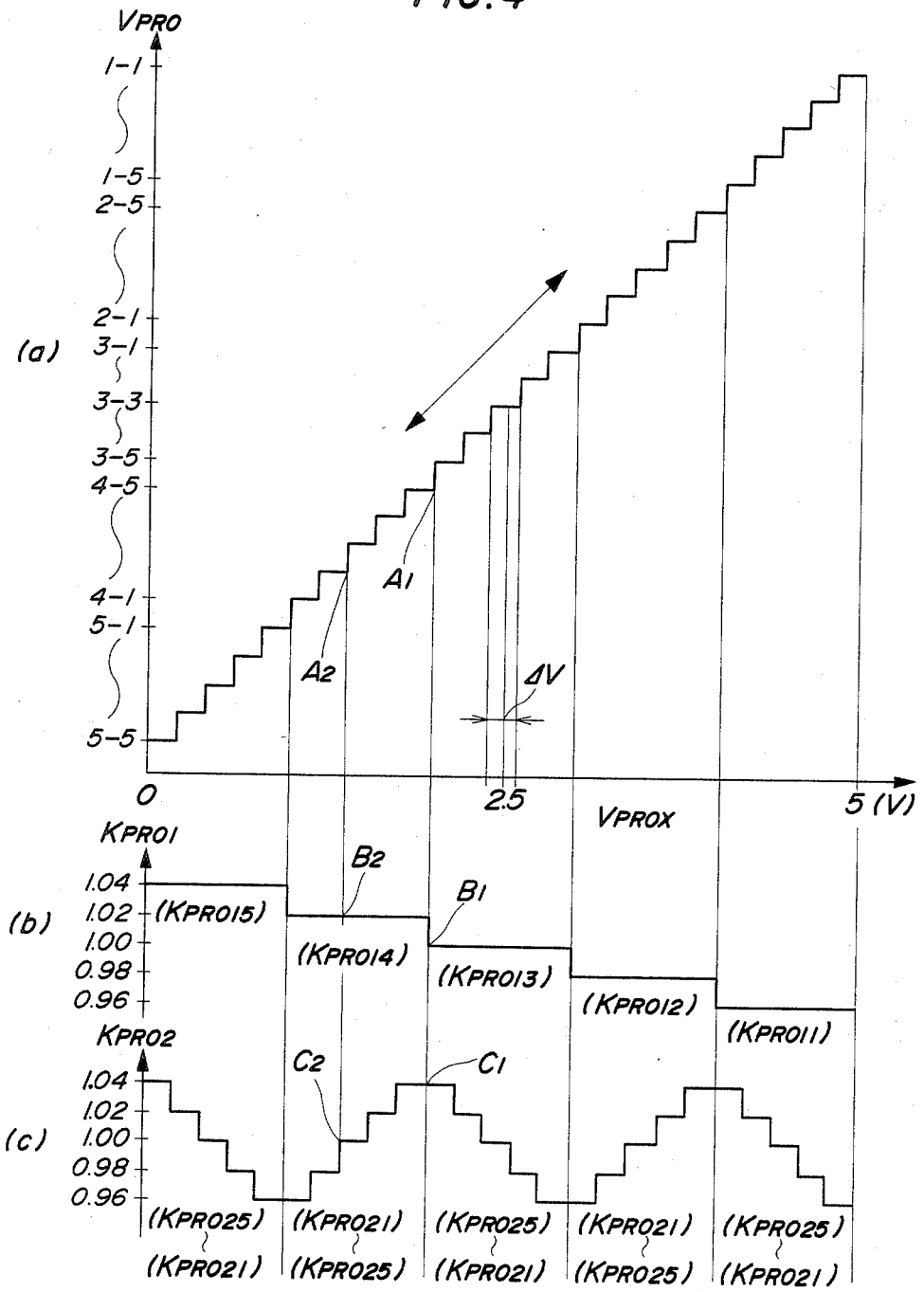
FIG. 4 is a graph showing the relationship between the values KPRO1, KPRO2, and VPRO in the table of FIG. 3.

The table of FIG. 4 is set such that the VPRO value has its median value 3—3 corresponding to the median value of 2.5 volts of the set voltage VPROX, and a change of the set voltage VPROX by one step (=0.2 volt) causes a corresponding change only in either the KPRO1 value or the KPRO2 value (that is, the two values do not change at the same time), as will be understood from the setting of the KPRO1 value and the KPRO2 value in (b) and (c) of FIG. 4. FIG. 5 shows a tabulated form of the relationship between values VPROX, VPRO, KPRO1, and KPRO2 in accordance with the table of FIG. 4. The setting of FIGS. 4 and 5 prevents that a slight change in the set voltage value VPROX adjusted by the VPRO value adjuster 511 will cause large changes in the values KPRO1 and KPRO2.

Assuming, for instance, that the set voltage value VPROX falls in the vicinity of the point A1 in (a) of FIG. 4, a slight change in the set voltage value VPROX will cause the value KPRO1 to change to either 1.02 or to 1.00 along the line B1 in (b) of FIG. 4, but the value KPRO2 will remain unchanged at 1.04 on the level C1 in (c) of FIG. 4 even with such slight change in the value VPROX.

Supposing that the set voltage value VPROX changes across the point A2 in (a) of FIG. 4, the correction coefficient KPRO1 will continue to assume the value of 1.02 on the level B2 in (b) of FIG. 4, while the correction coefficient KPRO2 will change to either 0.98 or 1.00 along the line C2 in (c) of FIG. 4.

As is learned from the above description, even if there is a deviation in the setting of the set voltage value VPROX, the resulting deviation will take place only in either the correction coefficient KPRO1 or KPRO2, thus minimizing the deviation in the calculated fuel injection period TOUT. In other words, even with a deviation in the setting of the set voltage value VPROX, the resulting deviation of the air fuel ratio will take place only in either the higher engine rpm region or the lower engine rpm region.

Further, the set voltage value VPROX is provided with predetermined tolerances V (=0.2 volt), so as to avoid deviation of the KPRO1 value and/or the KPRO2 value from a set value thereof once it has been set.

The correction coefficients KPRO1 and KPRO2 are set to optimum values by adjusting the set voltage value VPROX of the the VPRO value adjuster 511 in FIG. 2, at assemblage for incorporating a fuel supply control system employing the method of the invention into an engine, at periodic maintenance operation, etc.

By adjusting the set voltage value VPROX of the VPRO value adjuster 511 so as to select the correction coefficient KPRO of the multiplicative term of the aforementioned equation (1) from the value KPRO1 and KPRO2, it is possible to cope with all possible cases in which the air/fuel ratio of the mixture becomes deviated from desired values.

FIG. 6 shows an exemplary manner of executing the method of the invention.

When the ignition switch of the engine is turned on, the ECU 5 in FIG. 2 is initialized, and at the same time the set VPRO value is read into the CPU 503, at the step 30. Values of the correction coefficients KPRO1 and KPRO2 are read from the ROM 507 in FIG. 2, which correspond to the set VPRO value, at the step 31.

Next, a determination is made as to whether or not the engine speed Ne is higher than a predetermined value N (Ne>N), that is, whether or not the engine is in the high engine rpm region at the step 32. If the answer to the above determination is negative (No), the step 33 is executed wherein the CPU 503 selects the correction coefficient KPRO1 for the lower engine rpm region out of the correction coefficients KPRO1 and KPRO2 read from the ROM 507 at the step 31, and using the selected correction coefficient KPRO1, calculates the fuel injection period TOUT with the aforementioned equation (1). On the other hand, if the answer to the determination at the step 32 is positive (Yes), the step 34 is executed wherein the CPU 503 calculates the fuel injection period TOUT with the aforementioned equation (1) using the selected correction coefficient KPRO2 read from the ROM 507 at the step 31.

Figure 7:
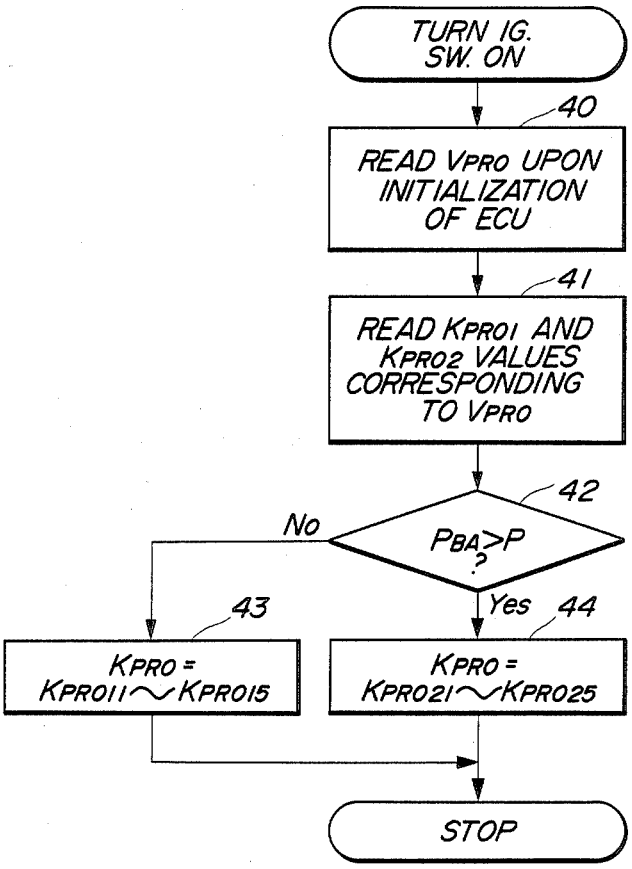
FIG. 7 is a flowchart of another manner of executing the method of the invention.

Althought in the embodiment described above, the two correction coefficients KPRO1 and KPRO2 are selected depending upon whether the engine is operating in the lower engine rpm region or in the higher engine rpm region in the light of the fact that the air-fuel ratio changes in different manners between the two engine rpm regions, this is not limitative, but it may be so arranged that the correction coefficients KPRO1 and KPRO2 may be selected in response to another operating parameter, for instance, intake pipe absolute pressure $P_B$ (FIG. 7).

Furthermore, although the foregoing embodiment is directed to setting of the correction coefficient KPRO, the method according to the present invention may be applied to setting of other correction coefficients or correction variables based upon output voltage from the single voltage creating means as well as an operating parameter or operating parameters of the engine. That is, if the method according to the present invention is applied to setting of a correction variable based upon output voltage from the single voltage creating means, a value of the correction variable set by the single voltage creating means may be added to the basic value of the quantity of fuel together with the other correction variables, to determine the quantity of fuel for supply to the engine.

What is claimed is:

1. A method of controlling the fuel supply to an internal combustion engine, wherein a quantity of fuel for supply to said engine is determined by correcting a basic value of the quantity of fuel determined as a function of at least one operating parameter of said engine by correction values dependent upon operating conditions of said engine, and the determined quantity of fuel is supplied to said engine, the method comprising the steps of:

(1) detecting a value of at least one predetermined operating parameter of said engine;

(2) manually adjusting a single voltage creating means to set an output voltage therefrom to such a desired value as to compensate for deviation of the air/fuel ratio of a mixture supplied to said engine due to variations in operating characteristics of engines between different production lots or aging changes, a predetermined one of said correction values having a value thereof set as a function of said output voltage from said voltage creating means and dependent upon the detected value of said at least one predetermined operating parameter of said engine;

(3) determining a value of said predetermined one correction value corresponding to said set desired value of output voltage of said single voltage creating means, and then modifying the thus determined value in response to the detected value of said predetermined at least one operating parameter of said engine during engine operation; and (4) correcting the basic value of the quantity of fuel by said value of said predetermined one correction value having the thus modified value, and the other correction values.

2. A method of controlling fuel supply as claimed in claim 1, wherein said at least one predetermined operating parameter of said engine includes the rotational speed of said engine.

3. A method of controlling fuel supply as claimed in claim 1, wherein said at least one predetermined operating parameter of said engine includes intake pipe absolute pressure of said engine.

4. A method of controlling fuel supply as claimed in claim 1, wherein said basic value of the quantity of fuel is multiplied by the determined value of said predetermined one correction value together with the other correction coefficients, to determine the quantity of fuel for supply to said engine.

5. A method of controlling fuel supply as claim in claim 1, wherein the determined value of said predetermined one correction value is added to said basic value of the quantity of fuel together with the other correction variables, to determine the quantity of fuel for supply to said engine.

6. A method controlling fuel supply as claimed in claim 1, a plurality of predetermined values of said predetermined one correction value are stored in a table in a manner corresponding, respectively, to as many predetermined values of the output voltage from said single voltage creating means.

7. A method of controlling fuel supply as claimed in claim 1, wherein at least two correction values are provided as said predetermined one correction value, and values thereof are determined in response to said set desired value of output voltage of said single voltage creating means, one of said at least two correction values being selected in response to the detected value of said at least one predetermined operating parameter of said engine during engine operation.

* * * * *